US005720249A

United States Patent [19]

Betts et al.

[11] Patent Number: 5,720,249

[45] Date of Patent: Feb. 24, 1998

[54] APPARATUS AND METHOD FOR BURNING SPENT LUBRICATING OIL IN AN INTERNAL COMBUSTION ENGINE

[75] Inventors: Edward H. Betts, Chillicothe, Ill.; David M. Erickson, West Lafayette, Ind.; John L. Johnson, Jr., Brimfield, Ill.; Charles J. Kocian, Peoria, Ill.; Robert L. Weber, Lacon, Ill.

[73] Assignee: Caterpillar Inc., Peoria, Ill.

[21] Appl. No.: 740,943

[22] Filed: Nov. 5, 1996

[51] Int. Cl.[6] ..... F01M 3/00

[52] U.S. Cl. ..... 123/196 S

[58] Field of Search ..... 123/73 AP, 196 S, 123/196 A; 184/1.5

[56] References Cited

U.S. PATENT DOCUMENTS

| | | | |
|---|---|---|---|
| 4,421,078 | 12/1983 | Hurner | 123/196 S |
| 4,869,346 | 9/1989 | Nelson | 184/1.5 |
| 5,092,429 | 3/1992 | Linares et al. | 184/1.5 |
| 5,238,085 | 8/1993 | Engelmann | 123/196 S |
| 5,353,760 | 10/1994 | Zager | 123/196 S |
| 5,431,138 | 7/1995 | Hurner | 123/196 S |
| 5,476,073 | 12/1995 | Betts | 123/196 A |
| 5,554,278 | 9/1996 | Henderson | 184/1.5 |
| 5,562,181 | 10/1996 | Elkin et al. | 184/1.5 |
| 5,586,583 | 12/1996 | Edwards et al. | 184/1.5 |

*Primary Examiner*—Erick R. Solis

*Attorney, Agent, or Firm*—Mario J. Donato, Jr.

[57] ABSTRACT

The present invention relates generally to an engine control system, and more particularly to an engine control system that decreases the amount of waste oil that must be disposed of in an internal combustion engine by automatically burning spent oil based upon engine speed.

9 Claims, 4 Drawing Sheets

APPARATUS AND METHOD FOR BURNING SPENT LUBRICATING OIL IN AN INTERNAL COMBUSTION ENGINE

TECHNICAL FIELD OF THE INVENTION

The present invention relates generally to an engine control system, and more particularly to an engine control system that decreases the amount of waste oil that must be disposed of in an internal combustion engine by automatically burning spent oil.

BACKGROUND OF THE INVENTION

Internal combustion engines are used on many trucks, cars, construction equipment, self propelled vehicles and other equipment. Typically the engines must have lubricating oil to run without being damaged. The lubricating oil is pumped throughout interior cavities of the engine to lubricate metal to metal contact. Excess oil falls in to a sump or oil pan where it is then pumped back out into the engine cavities.

As it lubricates the engine, the oil begins to wear and lose its lubricating properties. At some point, the lubricating qualities fall below a minimum standard, and the oil needs to be drained from the engine and replaced with new oil. The waste oil must then be discarded. Typically, the disposal of waste oil is regulated by various governmental entities and it is necessary to pay for its disposal. In automobiles, disposal is not a major operating expense of the vehicle. However, when using equipment with larger engines that have a greater oil capacity, such as large construction equipment, disposing of the oil is more costly. Moreover, the oil changes result in down time of the vehicle. The cost is compounded by having many such pieces of equipment, such as in a large mining operation.

Engine control systems that inject engine lubricant into the fuel supply to thereby burn spent oil are known in the art. For example, U.S. Pat. No. 4,869,346 discloses a method and apparatus for automatically changing engine lubricating oil while the engine is running. At predetermined time periods, the system removes a small increment of the lubricating fluid. At approximately the same time, the system injects a corresponding increment of new oil. An oil level sensor located in the sump pan is used to determine whether the used oil is injected into the fuel system to be burned with the fuel, or is instead returned to the sump. If the oil level sensor senses an oil level below a predetermined level, then the oil is returned to the sump. In that case the increment of new oil raises the oil level in the sump. In this manner, small increments are periodically added to the sump in an attempt to keep the oil fresh and to keep it at an appropriate level.

Another type of engine control system is disclosed in U.S. Pat. No. 5,092,429. It includes a subsystem that calculates engine wear based on actual engine activity, preferably by measuring the number of engine revolutions. The subsystem provides a signal to the vehicle operator when it is time to change the engine lubricating oil. The operator then manipulates dash switches to cause a valve to open and the used lubricating oil to drain into a waste oil reservoir. Then, fresh oil is pumped into the engine to replace the spent oil. However, if the engine is running or if an overheat condition is sensed, then a safety relay prevents operation of the system by not permitting oil to flow through the pump and further by not allowing oil to be drained from the oil pan.

The present invention is directed to overcoming one or more of the problems set forth above.

SUMMARY OF THE INVENTION

The present invention is directed towards an engine control system that decreases the amount of waste oil that must be disposed of in internal combustion engines by automatically burning spent oil. The system includes a spent lubricant reservoir, a fuel tank having a supply line and a return line, and a spent lubricant pump operatively connected to the spent lubricant reservoir and the fuel tank return line to affect transfer of spent lubricant from the spent lubricant reservoir to the fuel tank, thereby creating an oil/fuel mixture within the fuel tank. A plurality of sensors are provided, the sensors sensing various engine parameters. A fuel pump is provided, and is operatively connected to the fuel tank and to fuel injectors to affect transfer of the oil/fuel mixture from the fuel tank to the fuel injectors. In addition, an electronic controller is connected to the spent lubricant pump and valve, the plurality of sensors, the fuel injectors, and the fuel pump. The electronic controller receives inputs from the plurality of sensors, compares the sensor inputs to predetermined values, and selectively controls the actuation and timing of the spent lubricant pump and valve, the injectors, and the fuel pump so that a predetermined amount of oil/fuel mixture is injected into engine cylinders, thereby burning the spent engine lubricant.

BRIEF DESCRIPTION OF THE DRAWINGS

For a better understanding of the present invention, reference may be made to the accompanying drawings, in which.

DESCRIPTION OF A PREFERRED EMBODIMENT OF THE INVENTION

Figure 1:
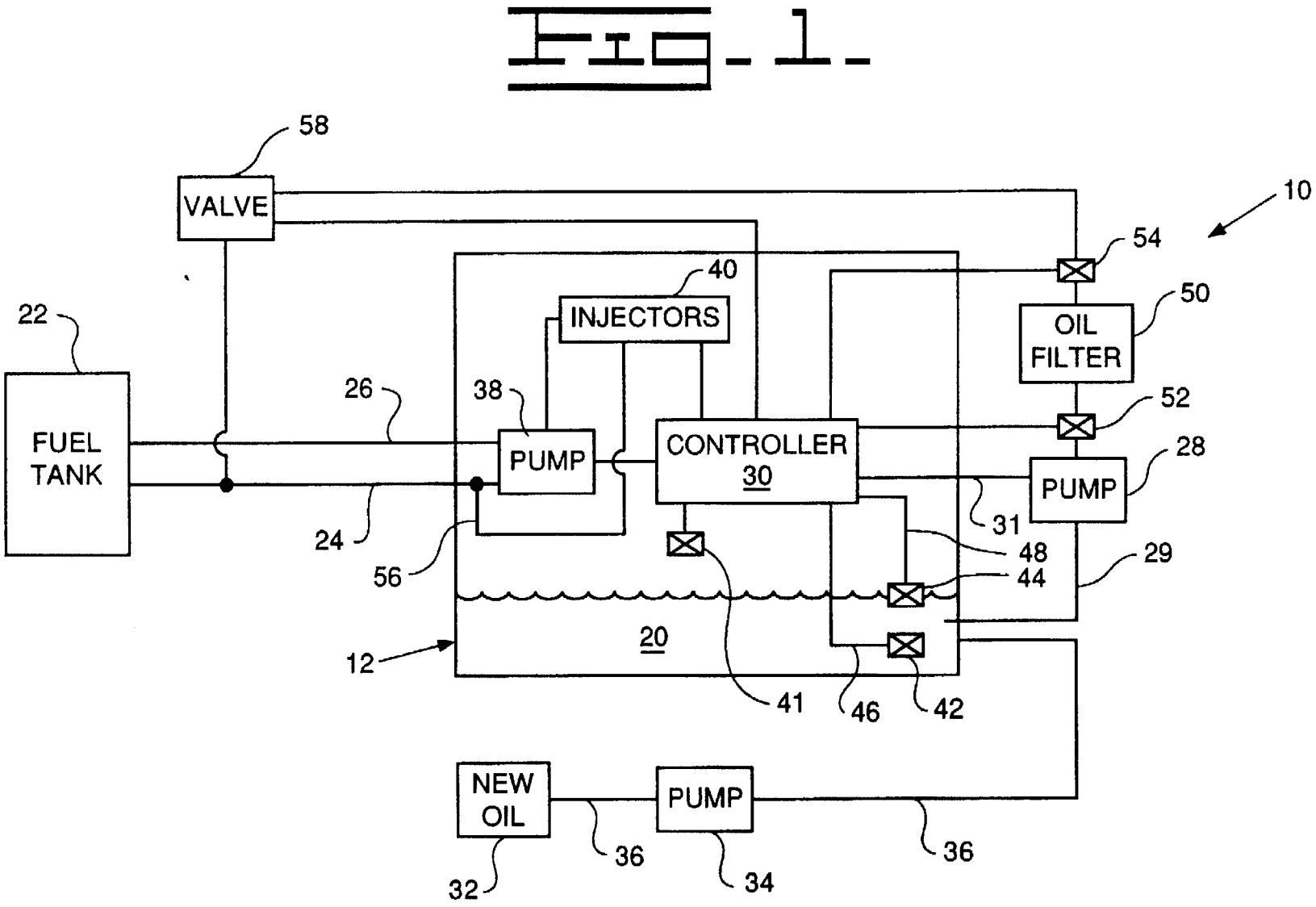
FIG. 1 illustrates in block schematic form an embodiment of an engine control system embodying principles of the present invention.

A system embodying the principles of the invention is illustrated generally in FIG. 1. The system 10 is designed to be employed in connection with an internal combustion engine 12. As illustrated, the system 10 is designed to interconnect a spent oil/lubricant reservoir or sump 20 with the return line 24 to the fuel tank 22, where it mixes with the fuel and is injected into the engine cylinders and burned. To affect flow of oil to and from the oil sump 20, a used oil pump 28 is provided. A new oil/lubricant reservoir 32 may be connected to the engine 12 via a replacement oil pump 34 and conduit 36 so that oil in the oil sump 20 can be changed/replaced as desired. However, the main objective of the instant invention is to extend the length of time between oil changes, and it is therefore understood by those skilled in the art that it is not required to have a system that automatically adds fresh oil to make up for the oil that is removed and burned in the engine.

As seen in FIG. 1, the engine 12 includes a fuel pump 38, fuel injectors 40, and a plurality of sensors 41, the sensors sensing various machine and/or engine parameters such as jacket water temperature, engine speed, etc., all connected to the electronic controller 30. The engine speed sensor is connected to the engine 12, and preferably is in the form of a magnetic pick-up sensor adapted to produce a signal corresponding to the rotational speed of the engine 12. However, many suitable engine speed sensors are known in the art, any one of which could be employed in connection with the present invention without departing from the scope of the invention as defined by the appended claims. In addition, many temperature sensors are known in the art, any one of which is suitable for use in connection with the present invention. In a preferred embodiment of the invention, a thermistor is used. The use of a thermistor is well known in the art. One skilled in the art could readily and easily include a thermistor and associated circuitry with the present invention to sense the temperature of the jacket water.

Although the sensors 41 are shown as being disposed within the engine 12, it will be appreciated by those skilled in the art that they may be disposed outside the engine, or that some of them may be disposed within the engine and some disposed outside the engine. The electronic controller 30 includes a microprocessor (not shown) connected to a memory device (not shown). As is known to those skilled in the art, the memory device generally stores both software instructions and data. The software instructions stored in the memory device include, among other things, the specific code that controls the engine. The data stored in the memory may either be permanently stored or may be temporarily written to the memory device by the microprocessor. The microprocessor is generally able to both read data and software instructions from, and write to, the memory device.

The fuel pump 38 is connected to the fuel tank 22 via supply line 26 and return line 24. The fuel pump 38 supplies the oil/fuel mixture to the injectors 40, which mixture is injected into the engine cylinders and burned as will be further described below. Contained within the oil sump 20 are oil level sensors 42 and 44, the sensors 42 and 44 being connected to the electronic controller 30 by electrical connections 46 and 48, respectively. The sensors 42 and 44 indicate the level of oil contained within the oil sump 20. In a preferred embodiment, the top sensor 44 indicates when the oil level in the oil sump 20 is below a predetermined level and that oil needs to be added to the sump 20. The lower level sensor 42 is used to provide a critical warning and may be used in a derate strategy. It signifies to an operator that the engine will be harmed if it continues to be run at the dangerously low oil level.

Upon command of the electronic controller 30, oil is pumped by pump 28 via conduit 29 from the oil sump 20 and passes through oil filter 50, which removes particulate matter from the oil. Oil pressure sensors 52 and 54 are connected to the oil filter 50 and to the electronic controller 30, and measure oil filter differential pressure. If the oil filter 50 is dirty or too plugged with contaminants, then an indication is made to an operator that the oil filter 50 needs to be replaced. Used oil pump 28 is connected to the electronic controller 30 and pumps the lubricating oil throughout the interior cavities of the engine 12 to lubricate metal to metal contact. In addition, the used oil pump 28 is connected to the return line 24 via valve 58, which meters and provides oil from the sump 20 to the fuel tank 22, thereby creating an oil/fuel mixture in the fuel tank 22. The oil/fuel mixture is then pumped from the fuel tank 22 to the injectors 40 via the supply line 26 and the fuel pump 38, and is burned in the engine cylinders (not shown). In a preferred embodiment, the fuel injectors are associated with each of the engine cylinders (not shown). As is known in the art, a solenoid is used in connection with each of the fuel injectors. Individual fuel delivery command signals are delivered to each of the solenoids to cause the solenoid to open and permit a specific volume of fuel to enter the engine cylinder. Such systems are well known in the art. One such system is disclosed is U.S. Pat. No. 5,197,867 entitled "Hydraulically-Actuated Electronically-Controlled Unit Injector Fuel System Having Variable Control of Actuating Fluid Pressure" which issued to Glassey on Mar. 9, 1993. An unused fuel line 56 is connected between the injectors 40 and the return line 24 to return any unused fuel from the injectors 40 to the fuel tank 22.

Figure 2A:
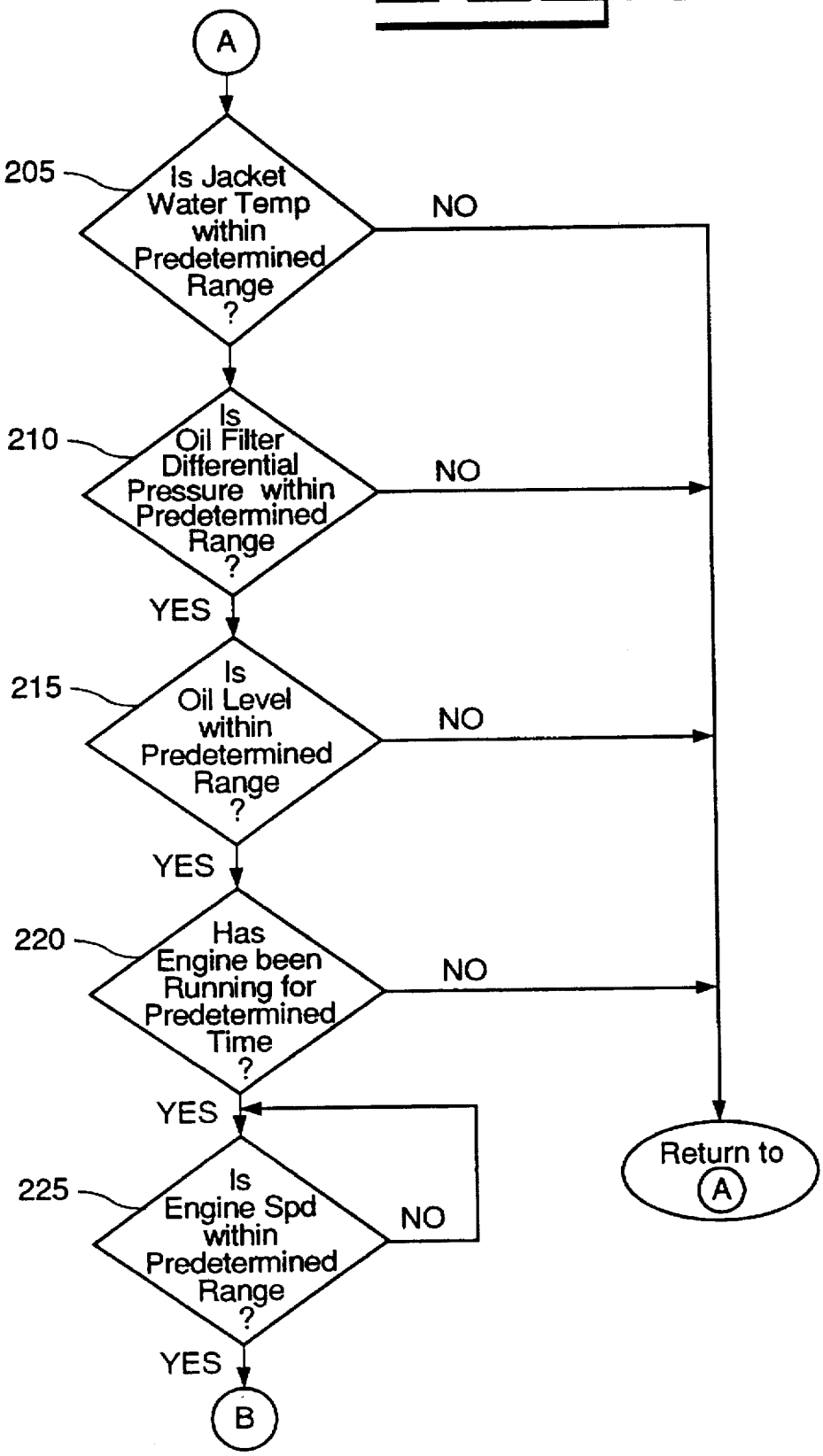
FIGS. 2A and 2B illustrate a flow chart of an algorithm used in an embodiment of the present invention.
Figure 2B:
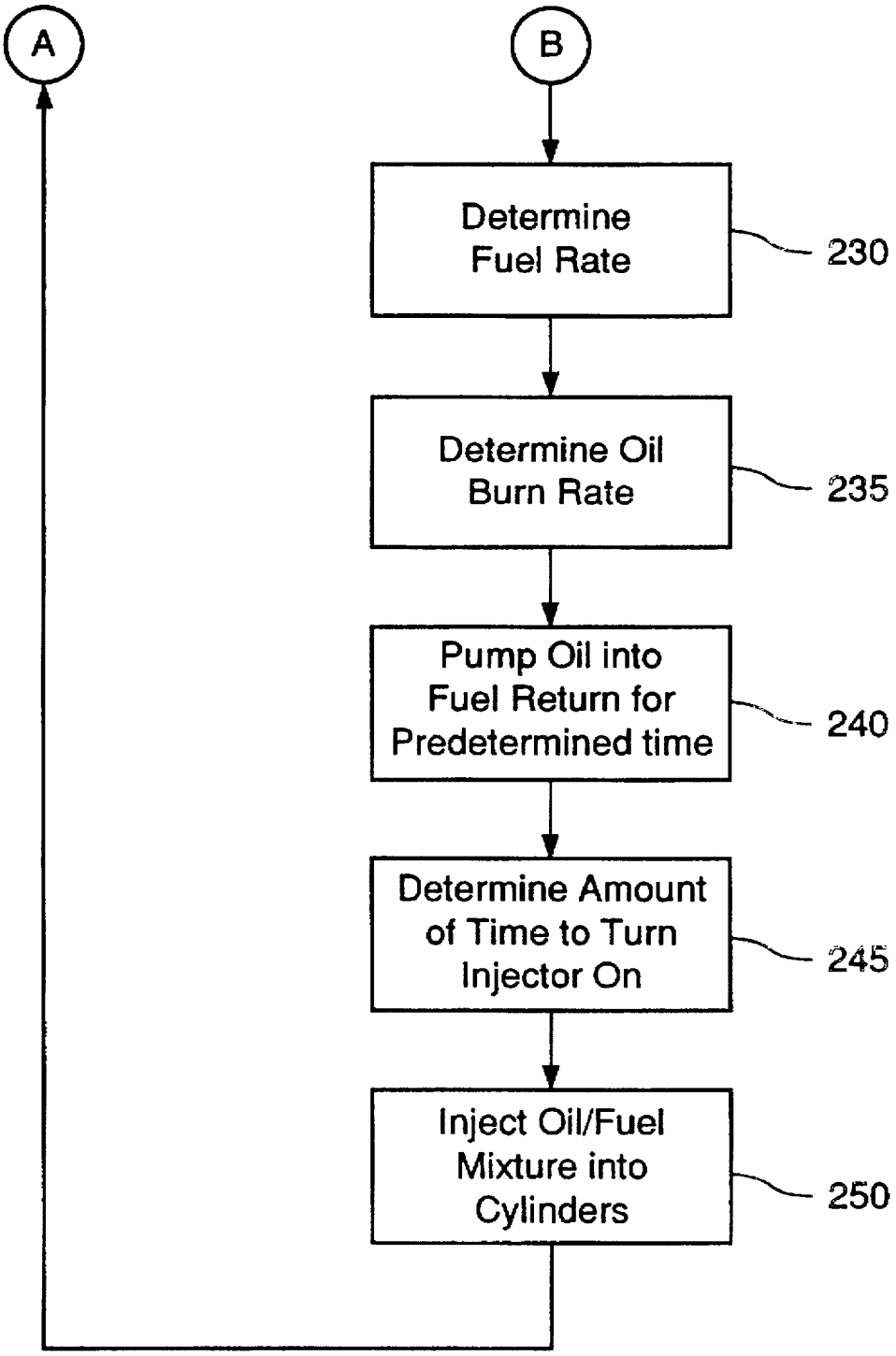

Referring now to FIG. 2, an algorithm used to implement the control strategy is depicted. In the preferred embodiment, a number of initial parameters are checked before enabling the oil injection system. As seen in FIG. 2, a determination is made at block 205 as to whether the jacket water temperature is within a predetermined range. Jacket water temperature is checked to ensure that the engine is warm, but not overheated. If the jacket water temperature is within the predetermined range, then a determination is made at block 210 as to whether the oil filter differential pressure is within a predetermined range. Oil filter differential pressure is checked to ensure that the oil filter is not clogged. If the oil filter differential pressure is within the predetermined range, then a determination is made at block 215 as to whether the oil level in the sump is within a predetermined range. If the oil level within the sump is within the predetermined range, then a determination is made at block 220 as to whether the engine has been running for a predetermined period of time. This ensures that the engine is warm and that "special" circumstances such as cold start-up of the engine are not a factor.

Figure 3:
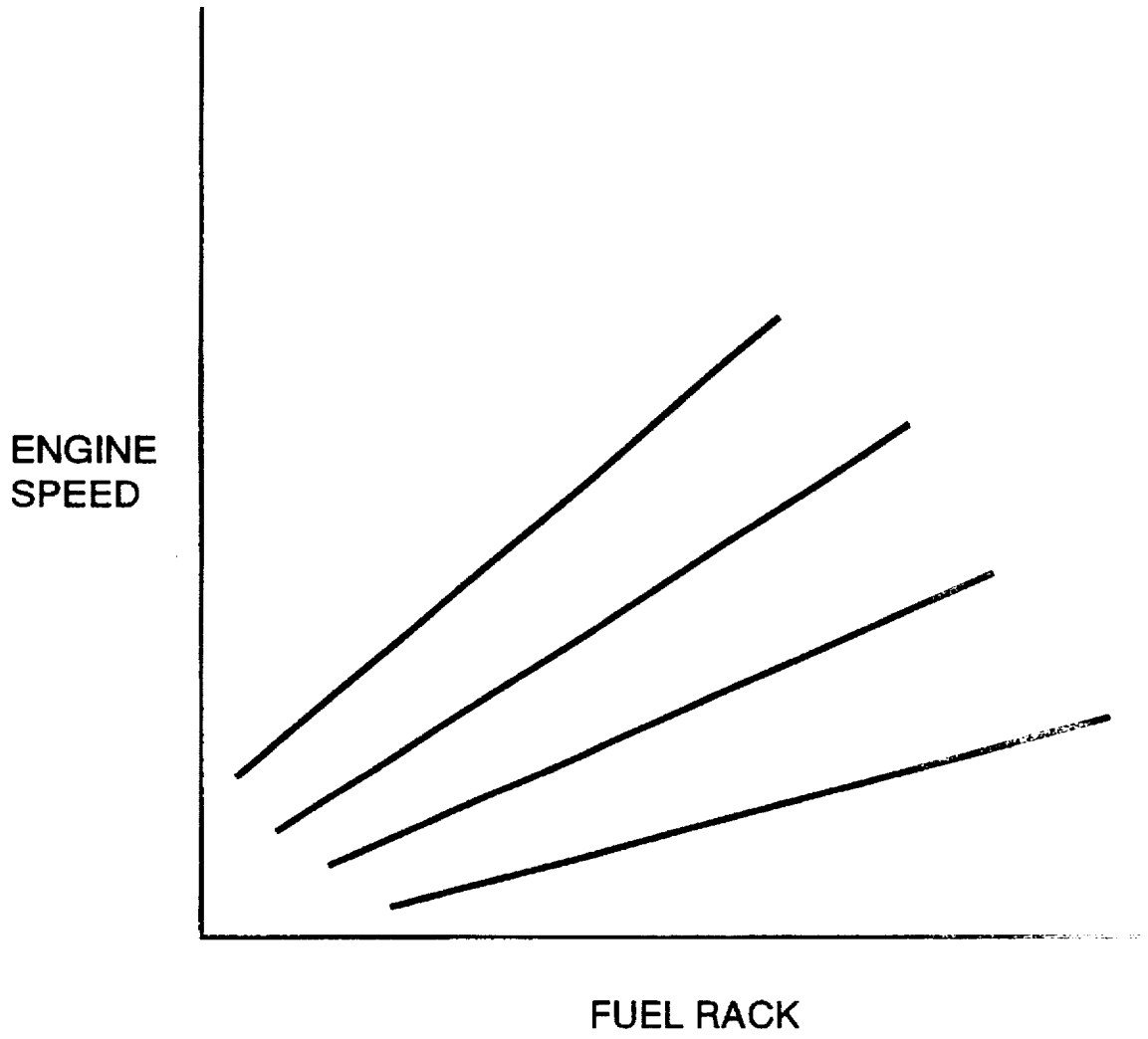
FIG. 3 illustrates in graphical form a map used in determining fuel rate.

Once a determination is made that the initial parameters have all been satisfied, then a determination is made at block 225 as to whether the engine speed is within a predetermined range by measuring engine Rpm's. This predetermined range is chosen so as to indicate that the engine has a load upon it (i.e. not in the idle state), thereby indicating that a significant amount of fuel is being burned. If the engine speed is within the predetermined range, then a determination is made at block 230 of the fuel rate. The fuel rate is determined by reference to a look up table or fuel rate map loaded in the memory of the electronic controller. In the preferred embodiment, a two-dimensional look-up table of a type well-known in the art is used to complete the comparison and select the value. The number of characteristics stored in memory is dependent upon the desired precision of the system. Interpolation may be used to determine the actual value in the event that the measured and calculated values fall between the discrete values stored in memory. The table values are based from simulation and analysis of empirical data. Although a look-up table is described, it is well know in the art that an empirical equation may readily be substituted for the look-up table if greater accuracy is desired. A representative illustration of a fuel rate map is depicted in FIG. 3, which depicts a plot of engine speed versus fuel rack position, and is typically expressed in terms of gallons/hour.

Once a determination is made of the fuel rate, then a determination is made at block 235 of the oil burn rate. The oil burn rate is analytically determined as follows: a predetermined oil/fuel ratio is preprogrammed into the memory of the electronic controller. It should be noted that a customer, such as a fleet manager, may be permitted to increase or decrease the oil/fuel ratio to more closely tailor the engine operating characteristics to his or her desired application by use of a service tool. The service tool is a communication device that permits a qualified technician to enter data or commands into the electronic controller memory or to download data or commands from the electronic controller memory.

Therefore, once the fuel rate is known, it is a simple matter to determine how many gallons of oil to burn per hour, thus determining the oil burn rate. By knowing the fuel rate and the oil burn rate, oil is then metered into the fuel return line and into the fuel tank for a predetermined period of time as shown at block 240. Additionally, by knowing the fuel rate and the oil burn rate, a determination is made at block 245 as to the amount of time to turn the injectors on so that the proper amount of oil/fuel mixture is injected into the cylinders to be burned. After determination is made as to the amount of time to turn the injector on, the oil/fuel mixture is injected into the cylinder as seen at block 250 and is burned accordingly. As discussed above, any unused fuel from the injectors is routed to the fuel tank via the unused fuel line, which is connected between the injectors and the return line to the fuel tank.

Thus, while the present invention has been particularly shown and described with reference to the preferred embodiment above, it will be understood by those skilled in the art that various additional embodiments may be contemplated without departing from the spirit and scope of the present invention.

We claim:

1. A system for burning spent engine lubricant of an internal combustion engine, comprising:

a spent lubricant reservoir;

a fuel tank having a supply line and a return line connected thereto;

a spent lubricant pump and valve operatively connected to said spent lubricant reservoir and said fuel tank return line to affect transfer of spent lubricant from said spent lubricant reservoir to said fuel tank, thereby creating an oil/fuel mixture within said fuel tank;

a plurality of sensors, said sensors sensing various engine parameters;

fuel injectors;

a fuel pump operatively connected to said fuel tank and said injectors to affect transfer of said oil/fuel mixture from said fuel tank to said injectors;

a lubricant filter connected to said spent lubricant pump and valve, said filter removing contaminants from the spent engine lubricant;

lubricant pressure sensors connected to said lubricant filter, said lubricant pressure sensors measuring lubricant filter differential pressure; and an electronic controller connected to said spent lubricant pump and valve, said plurality of sensors, said lubricant pressure sensors, said fuel injectors, and said fuel pump;

wherein said electronic controller receives inputs from said plurality of sensors, from said lubricant pressure sensors, compares the sensor inputs to predetermined values, and selectively controls the actuation and timing of said spent lubricant pump and valve, said injectors, and said fuel pump so that a predetermined amount of oil/fuel mixture is injected into engine cylinders, thereby burning the spent engine lubricant.

2. A system as recited in claim 1, including a replacement lubricant reservoir; and a replacement lubricant pump operatively connected to said spent lubricant reservoir and said replacement lubricant reservoir to affect transfer of replacement lubricant from said replacement lubricant reservoir to said spent lubricant reservoir, said replacement lubricant pump connected to said electronic controller, said electronic controller controlling the actuation and timing of said replacement lubricant pump.

3. A system as recited in claim 1, wherein said plurality of sensors includes lubricant level sensors disposed within said spent lubricant reservoir, wherein one of said lubricant level sensors indicates when the lubricant level in the spent lubricant reservoir is below a predetermined level and that lubricant needs to be added to the spent lubricant reservoir, and further wherein another of said lubricant level sensors indicates when the lubricant level in the spent lubricant reservoir is at a dangerously low level.

4. A system as recited in claim 3, including an unused fuel line connected between the injectors and the return line to return any unused fuel from the injectors to the fuel tank.

5. A method of burning waste engine oil contained in a spent oil reservoir of an internal combustion engine, comprising the steps of:

determining whether a plurality of initial engine parameters are within predetermined ranges;

measuring engine speed;

determining fuel rate based upon the engine speed measurement;

determining oil burn rate based upon the fuel rate;

delivering waste engine oil from the spent oil reservoir into a fuel tank connected to the engine for a predetermined period of time, thereby creating an oil/fuel mixture within the fuel tank;

delivering the oil/fuel mixture to engine fuel injectors; and injecting the oil/fuel mixture into engine cylinders, thereby burning the waste engine oil.

6. A method as recited in claim 5, wherein said step of determining whether a plurality of initial parameters are within predetermined ranges includes the step of determining jacket water temperature.

7. A method as recited in claim 6, including the step of determining oil filter differential pressure.

8. A method as recited in claim 7, including the step of determining oil level.

9. A method as recited in claim 8, including the step of determining whether the engine has been operating for a predetermined period of time.

* * * * *